US007185598B1

(12) United States Patent
Lan et al.

(10) Patent No.: US 7,185,598 B1
(45) Date of Patent: Mar. 6, 2007

(54) SWIM TRAINING AND BUOYANCY ASSIST DEVICE

(76) Inventors: Jen-Fan Lan, No. 3, Fuyu 13 St., Hualien (TW); Jenn-Jian Lan, No. 131, Jhongmei Rd., Hualien (TW)

( * ) Notice: Subject to any disclaimer, the term of this patent is extended or adjusted under 35 U.S.C. 154(b) by 0 days.

(21) Appl. No.: 11/254,414

(22) Filed: Oct. 20, 2005

(51) Int. Cl.
*F16G 11/00* (2006.01)

(52) U.S. Cl. ..... 114/215; 482/55

(58) Field of Classification Search ..... 441/55; 482/55; 114/215
See application file for complete search history.

(56) References Cited

U.S. PATENT DOCUMENTS 4,044,415 A * 8/1977 Wood ..... 441/75
5,083,522 A * 1/1992 Ashrow ..... 114/215
5,846,167 A * 12/1998 Liu et al. ..... 482/55
6,467,713 B1 * 10/2002 Watanabe et al. ..... 242/375.1

* cited by examiner

*Primary Examiner*—Stephen Avila
(74) *Attorney, Agent, or Firm*—Alan D. Kamrath; Nikolai & Mersereau, P.A.

(57) ABSTRACT

A swim training and buoyancy assist device for an anchoring device has a resilient element and a resilient tether. The anchoring device is located at a certain location beside a swimming pool. The resilient element has a proximal end and a distal end. The proximal end of the resilient element is connected to the anchoring device. The resilient tether has a proximal end and a distal end. The proximal end of the resilient tether is connected to the distal end of the resilient element. The distal end of the resilient tether is connected to a swimmer. When the swimmer is connected to the resilient element and the resilient tether, the swimmer can only move a short distance in a certain direction and is buoyed up at a certain depth in the water so that the swimmer, especially a beginner, can practice swimming in a small area without the fear of drowning.

16 Claims, 6 Drawing Sheets

SWIM TRAINING AND BUOYANCY ASSIST DEVICE

BACKGROUND OF THE INVENTION

1. Field of the Invention

The present invention relates to a swim training device and, more particularly, to a swim training and buoyancy assist device that allows a swimmer to train in a small area of a swimming pool and that holds the swimmer at a certain depth and in a certain direction.

2. Description of the Related Art

Swimming is a very popular sport. Swimming helps people develop their muscles and their cardiovascular and respiratory systems.

A swimming pool is the best place to learn how to swim. However, at times, swimming pools can be very crowded. A beginner would have a very difficult time learning and practicing any style of swimming.

In addition, most people are not natural born swimmers. Some people find it very difficult to learn how to swim. Some of these people have a fear of the water; they get nervous when they are near or in the water. They are usually too tense and cannot relax their muscles, so they sink in the water. Another problem beginners have is difficulty in maintaining a certain direction when they swim, which can cause problems in crowded pools.

To overcome the shortcomings, the present invention provides a swim training and buoyancy assist device to obviate or mitigate the aforementioned problems.

SUMMARY OF THE INVENTION

The primary objective of the present invention is to provide a swim training and buoyancy assist device that allows a beginner to practice swimming in a small area of a swimming pool and assists in buoying up the swimmer at a certain depth in the water.

The swim training and buoyancy assist device has a resilient element and a resilient tether. An anchoring device is fixed at a certain location beside a swimming pool. The resilient element has a proximal end and a distal end. The proximal end of the resilient element is connected to the anchoring device. The resilient tether has a proximal end and a distal end. The proximal end of the resilient tether is connected to the distal end of the resilient element. The distal end of the resilient tether is connected to a swimmer. Attached to the resilient element and the resilient tether, the swimmer can only move a short distance in a certain direction and is buoyed up at a certain depth in the water. The swimmer can then practice swimming in the small area without the fear of colliding with other swimmers or drowning.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
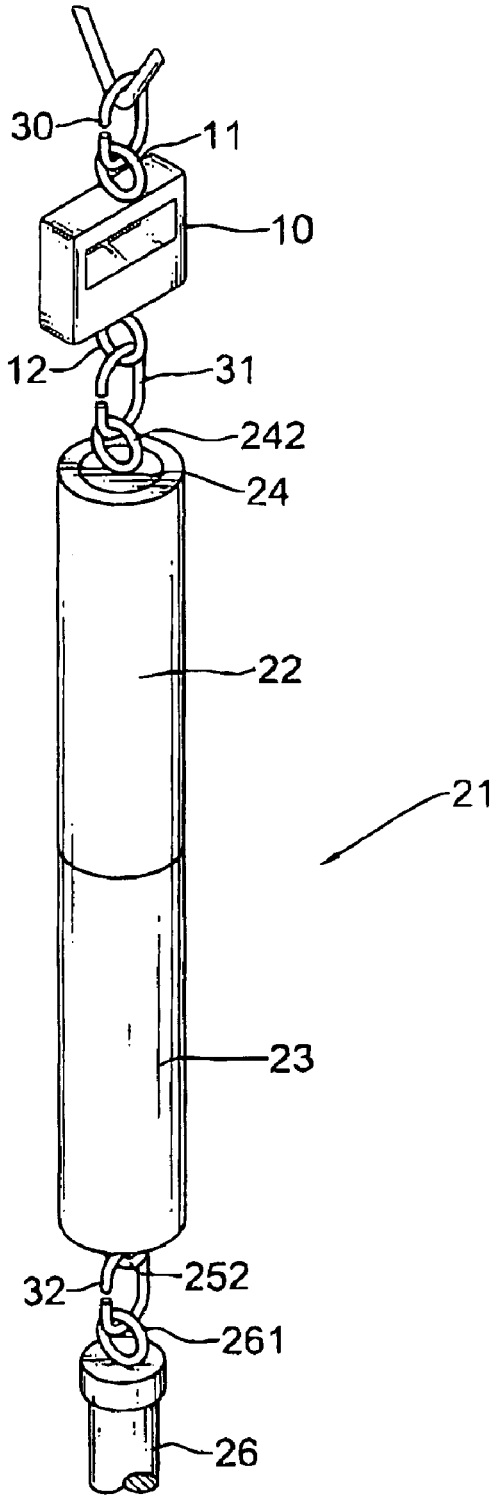
FIG. 1 is a perspective view of a swim training and buoyancy assist device in accordance with the present invention.

With reference to FIGS. 1, 2, 5 and 6, a swim training and buoyancy assist device in accordance with the present invention is connected to an anchoring device and comprises an optional tension meter (10), a resilient element (20), a resilient element housing (21), a resilient tether (26), an optional belt (42) and multiple optional connecting rings (30, 31, 32, 33).

The anchoring device is mounted at a certain location beside a swimming pool (50, 70). The area of the swimming pool (50, 70) may be as small as 3 m×1.5 m×1.5 m.

Figure 5:
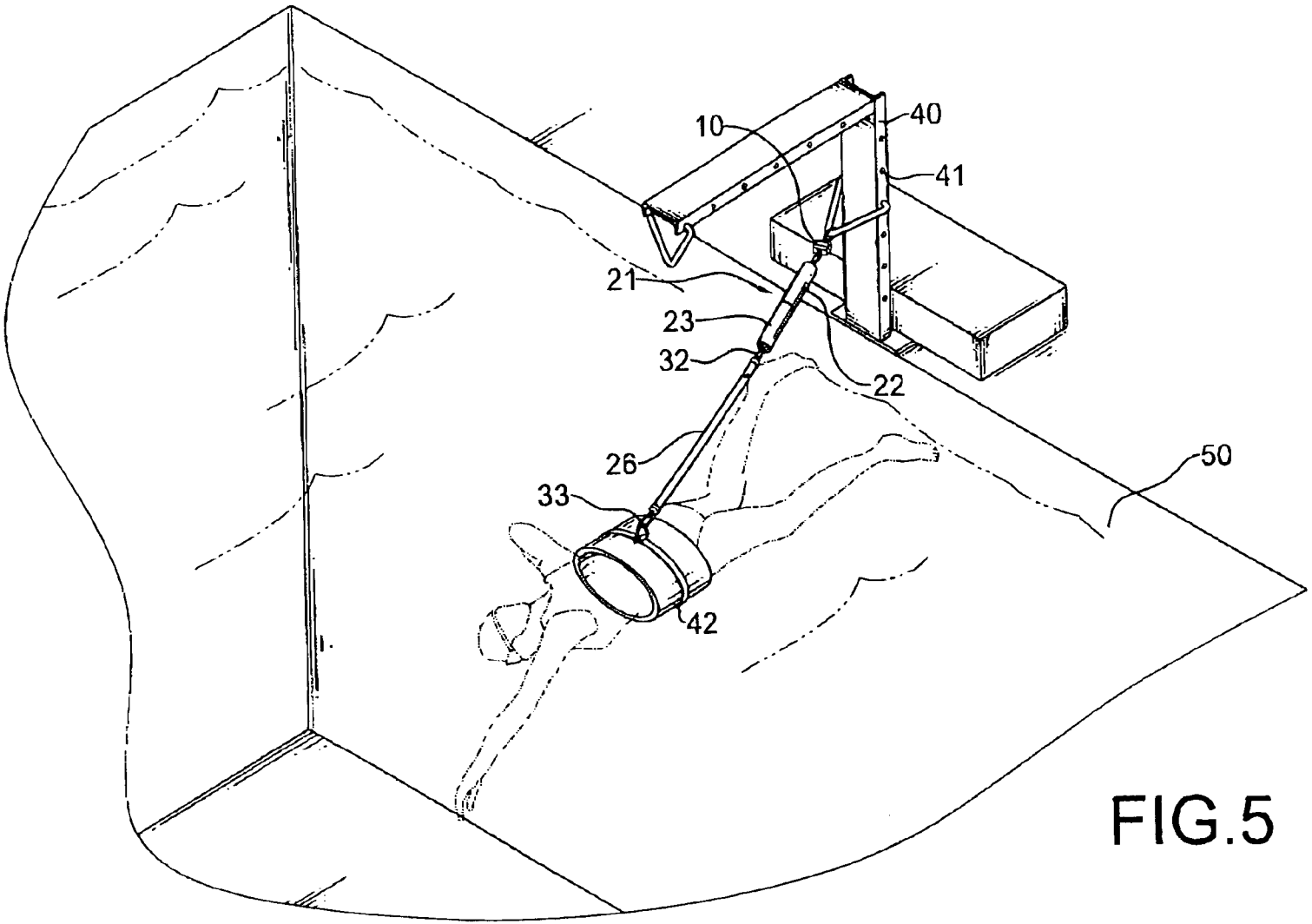
FIG. 5 is an operational perspective view of a first embodiment of the swim training and buoyancy assist device in accordance with the present invention.

With reference to FIG. 5, in a first embodiment of the anchoring device is an optional stand (40). The stand (40) has multiple holes (41) and a holder. The holes (41) are formed on opposite sides of the stand (40). The holder is engaged with a pair of corresponding holes (41) to mount the holder to the stand (40). The position of the holder can be adjusted by engaging the holder in different pairs of corresponding holes (41) in the stand (40).

Figure 6:
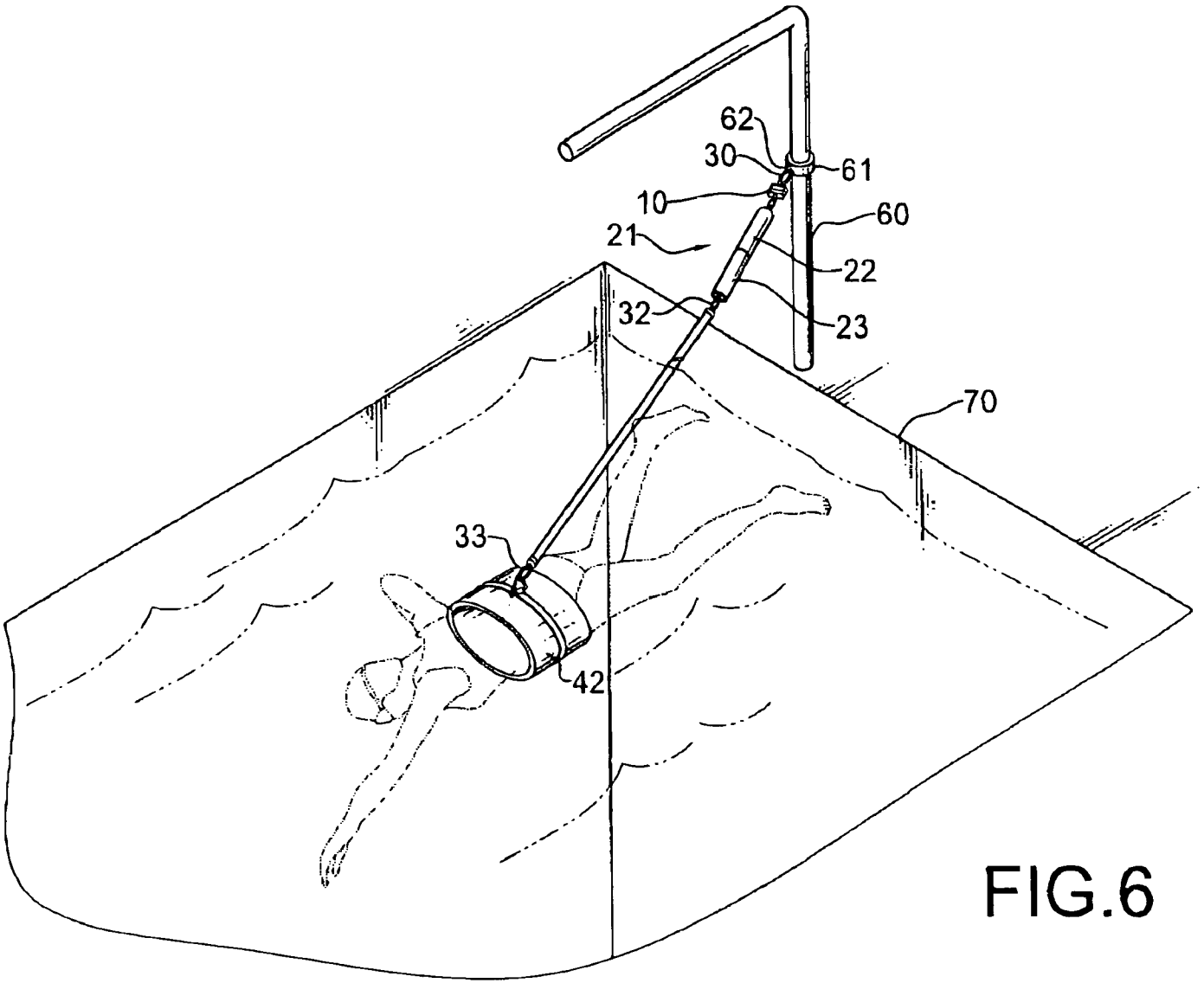
FIG. 6 is an operational perspective view of a second embodiment of the swim training and buoyancy assist device in accordance with the present invention.

With reference to FIG. 6, in a second embodiment of the anchoring device is an optional curved rod (60). The rod (60) has a locking ring (61). The locking ring (61) is slipped on over and locked to the rod (60), and has a side and an L-shaped hook (62). The locking ring (61) can be slid along the rod (60) to change its position. A bolt screws into the locking ring (61) to position the locking ring (61) in place on the anchoring device. The hook (62) is mounted on the side of the locking ring (61).

Furthermore, the anchoring device may be any stand that is able to connect to the resilient element (20).

The tension meter (10) is able to measure tensile force and has a top, a bottom, an optional upper ring (11) and an optional lower ring (12). The upper ring (11) is mounted on the top of the tension meter (10). The lower ring (12) is mounted on the bottom of the tension meter (10).

The resilient element housing (21) has an upper outer casing (22), a lower outer casing (23), an upper inner casing (24) and a lower inner casing (25).

Figure 2:
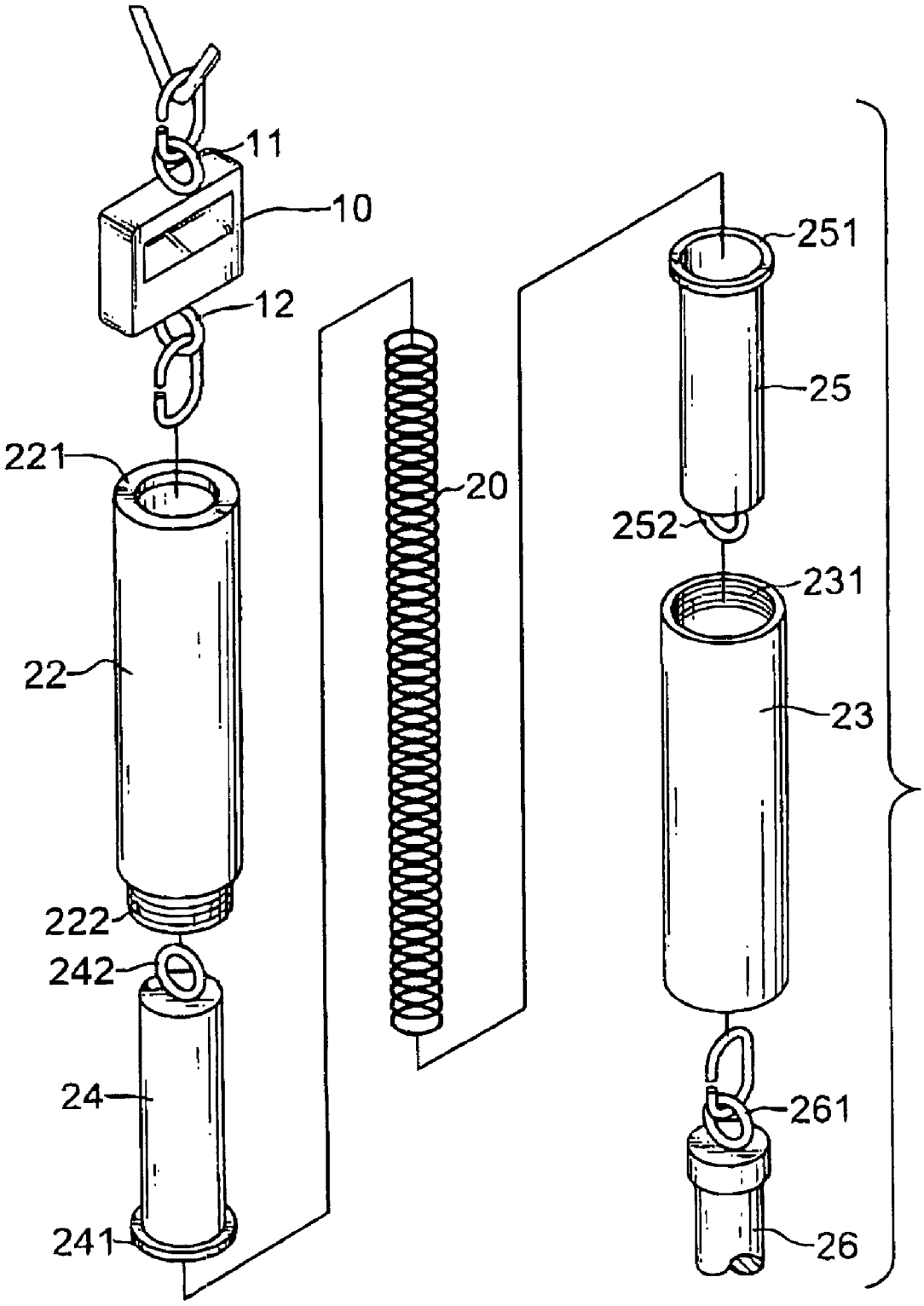
FIG. 2 is an exploded perspective view of the swim training and buoyancy assist device in FIG. 1.
Figure 3:
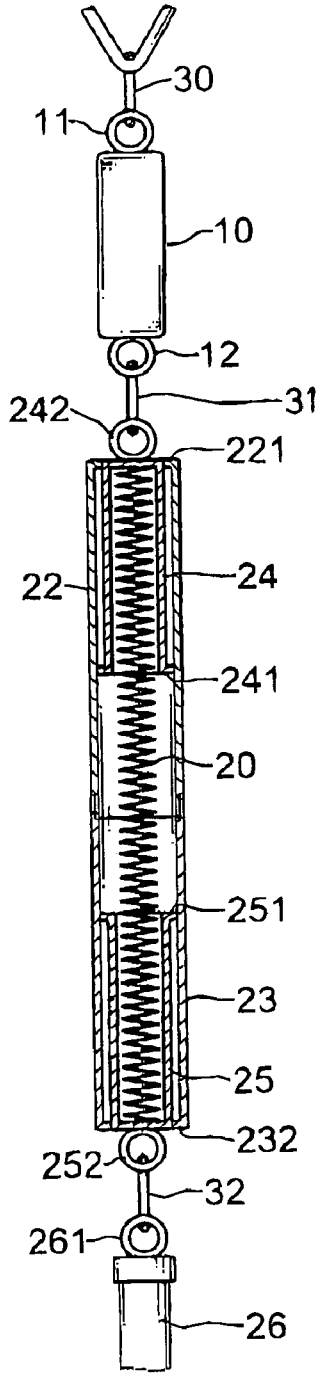
FIG. 3 is a side view in partial section of the swim training and buoyancy assist device in FIG. 1.

With reference to FIGS. 2 and 3, the upper outer casing (22) is hollow and has an upper opening, a lower opening, a flange (221), an outer surface and an optional thread (222). The flange (221) is formed at the upper opening of the upper outer casing (22). The thread (222) is formed on the outer surface of the upper outer casing (22) and near the lower opening of the upper outer casing (22).

The lower outer casing (23) is hollow and has an upper opening, a lower opening, an inner surface, an optional thread (231) and a flange (232). The thread (231) is formed in the inner surface of the lower outer casing (23), near the top opening of the lower outer casing (23) and screwing onto the thread (222) on the upper outer casing (22). The flange (232) is formed at the lower opening of the lower outer casing (23).

The upper inner casing (24) is located inside the upper outer casing (22), is able to extend out through the top opening of the upper outer casing (22) and has a bottom opening, a top, an outer surface, an inner top, a ring (242) and a shoulder (241). The ring (242) is mounted on top of the upper inner casing (24). The shoulder (241) is formed at the outer surface of the upper inner casing (24), near the bottom opening of the upper inner casing (24) and engages the flange (221) of the upper outer casing (22).

The lower inner casing (25) is located inside the lower outer casing (23), is able to extend out through the lower opening of the lower outer casing (23) and has a top opening, a bottom, an outer surface, an inner bottom, a ring (252) and a shoulder (251). The ring (252) is mounted on the bottom of the lower inner casing (25). The shoulder (251) is formed at the outer surface of the lower inner casing (25), near the top opening of the lower inner casing (23) and engages the flange (232) of the lower outer casing (23).

The resilient element (20) has a proximal end and a distal end. The proximal end of the resilient element (20) is mounted to the inner top of the upper inner casing (24). The distal end of the resilient element (20) is mounted to the inner bottom of the lower inner casing (25). The resilient element (20) may be a spring.

Figure 7:
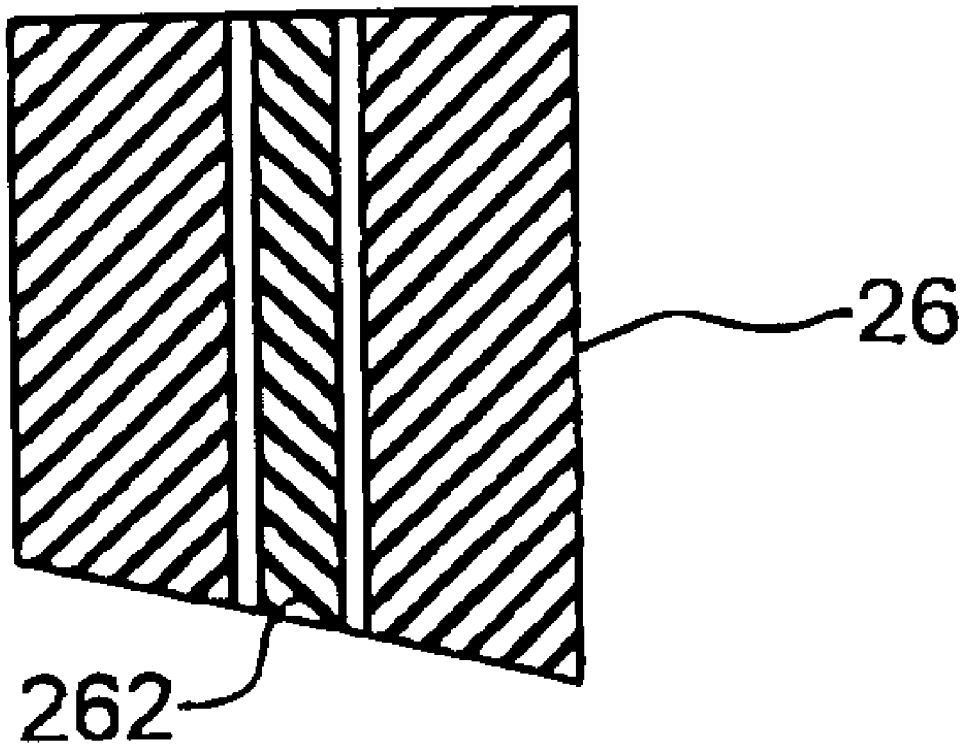
FIG. 7 is a cross-sectional view of a section of a resilient tether of the swim training and buoyancy assist device in accordance with the present invention.

With reference to FIGS. 2 and 7, the resilient tether (26) has a proximal end, a distal end, an optional top ring (261), an optional bottom ring and an optional non-resilient tether (262). The top ring (261) is mounted on the proximal end of the resilient tether (26). The bottom ring is mounted on the distal end of the resilient tether (26). The non-resilient tether (262) is located inside of the resilient tether (26) and limits the extension of the resilient tether (26).

The belt (42) has a side and a ring. The ring is mounted around the belt (42).

In the first embodiment of the swim training and buoyancy assist device, one of the connecting rings (30) is used to connect the upper ring (11) of the tension meter (10) to the holder of the stand (40).

In the second embodiment of the swim training and buoyancy assist device, one of the connecting rings (30) is used to connect the upper ring (11) of the tension meter (10) to the hook (62) of the rod (60).

A second connecting ring (31) is used to connect the lower ring (12) of the tension meter (10) to the ring (242) of the upper inner casing (24).

A third connecting ring (32) is used to connect the ring (252) of the lower inner casing (25) to the top ring (261) of the resilient tether (26).

A final connecting ring (33) is used to connect the bottom ring of the resilient tether (26) to the ring of the belt (42).

With reference to FIGS. 5 and 6, to use the device, a swimmer puts on the belt (42) when the swimmer is in the swimming pool (50, 70). The swimmer starts to swim. The resilient tether (26), the resilient element housing (21), the resilient element (20) and the tension meter (10) are pulled by the swimmer. The tension meter (10) is able to measure the tensile force exerted by the swimmer.

Figure 4:
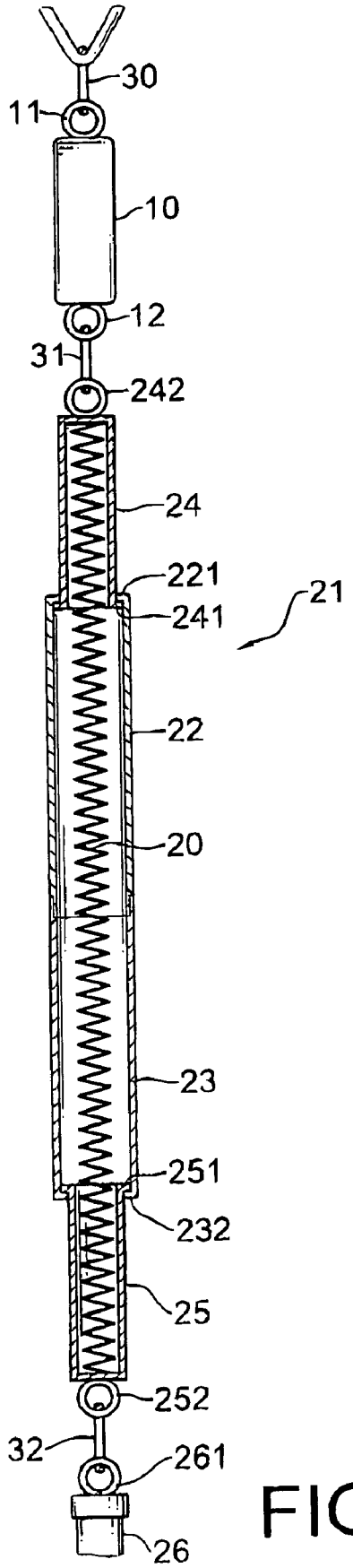
FIG. 4 is a side view in partial section of the swim training and buoyancy assist device in FIG. 1 under tension.

With reference to FIGS. 3 and 4, under tension, the upper inner casing (24) and the lower inner casing (25) extend out of the upper outer casing (22) and the lower outer casing (23), respectively. When the upper inner casing (24) and the lower inner casing (25) extend out, the resilient element (20) is extended between the upper inner casing (24) and the lower inner casing (25). When the flange (221) of the upper outer casing (22) abuts the shoulder (241) of the upper inner casing (24) and the shoulder (251) of the lower inner casing (25) abuts the flange (232) of the lower outer casing (23), the resilient element (20) is not able to extend any further.

The resilient tether (26) is also only able to extend to a certain length because of the restriction of the non-resilient tether (262). The limited range of extension of the resilient tether (26) and the resilient element (20) keeps the swimmer at a certain depth in the swimming pool (50, 70). The swimmer, especially a beginner, would not have to worry about sinking and drowning.

Furthermore, the resilient tether (26) only allows the swimmer to move forward a short straight distance and is restrained by the resilient tether (26), so the swimmer would only need a small area to practice swimming.

The distal end of the resilient tether (26) also can directly tie on the swimmer's body without the belt (42). Even so, the resilient tether (26) is able to provide as said function to the swimmer.

In conclusion, the resilient element (20) and the resilient tether (26) restrain the swimmer to only moving a short distance in one direction and assist in buoying up the swimmer at a certain depth in the water, so the swimmer can practice in a small area without the fear of drowning.

Even though numerous characteristics and advantages of the present invention have been set forth in the foregoing description together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A swim training and buoyancy assist device for an anchoring device being mounted at a certain location beside a swimming pool, the swim training and buoyancy assist device comprising a resilient element having
- a proximal end; and
- a distal end;

a resilient tether connected to the resilient element and having
- a proximal end; and
- a distal end; and a resilient element housing having
- an upper outer casing being hollow and having
  - an upper opening;
  - a lower opening;
  - a flange formed at the upper opening of the upper outer casing; and
  - an outer surface;
- a lower outer casing being hollow and combining with the upper outer casing and having
  - an upper opening;
  - a lower opening;
  - an inner surface; and
  - a flange formed at the lower opening of the lower outer casing;
- an upper inner casing located inside the upper outer casing, extending out through the upper opening of the upper outer casing and having
  - a bottom opening;
  - a top;
  - an outer surface;
  - an inner top;
  - a ring mounted on the top of the upper inner casing; and
  - a shoulder formed at the outer surface of the upper inner casing, near the bottom opening of the upper inner casing and engaging the flange of the upper outer casing; and
- a lower inner casing mounted inside the lower outer casing, extending out through the lower opening of the lower outer casing and having
  - a top opening;
  - a bottom;
  - an outer surface;
  - an inner bottom;

a ring mounted on the bottom of the lower inner casing; and a shoulder formed at the outer surface of the lower inner casing, near the top opening of the lower inner casing and engaging the flange of the lower outer casing;

wherein the proximal end of the resilient element is attached to the inner top of the upper inner casing;

the distal end of the resilient element is attached to the inner bottom of the lower inner casing; and the proximal end of the resilient tether is connected to the ring of the lower inner casing.

2. The swim training and buoyancy assist device as claimed in claim 1 further comprising a tension meter having a top and a bottom, with the bottom connected to the ring of the upper inner casing.

3. The swim training and buoyancy assist device as claimed in claim 2 further comprising multiple rings; and the tension meter further has a lower ring mounted on the bottom of the tension meter; and the resilient tether further has a top ring mounted on the proximal end of the resilient tether;

wherein one of the connecting rings connects the lower ring of the tension meter to the ring of the upper inner casing; and one of the holding rings connects the ring of the lower inner casing to the top ring of the resilient tether.

4. The swim training and buoyancy assist device as claimed in claim 3, wherein the resilient tether has a non-resilient tether inside of the resilient tether.

5. The swim training and buoyancy assist device as claimed in claim 4 further comprising a belt having a side and a ring mounted around the belt; and the resilient tether further has a bottom ring mounted on the distal end of the resilient tether;

wherein one of the connecting rings connects the bottom ring of the resilient tether to the ring of the belt.

6. The swim training and buoyancy assist device as claimed in claim 5, wherein the upper outer casing further has a thread formed on the outer surface of the upper outer casing and near the lower opening of the upper outer casing; and the lower outer casing further has a thread formed in the inner surface of the lower outer casing near the top opening of the lower outer casing and screwing onto the thread on the upper outer casing.

7. The swim training and buoyancy assist device as claimed in claim 6, wherein the resilient element is a spring.

8. A swim training and buoyancy assist device for an anchoring device being mounted at a certain location beside a swimming pool, the swim training and buoyancy assist device comprising:

a resilient element having a proximal end, and a distal end;

a resilient tether connected to the resilient element and having a proximal end connected to the distal end of the resilient element, and a distal end; and a tension meter having a top and a bottom, with the bottom of the tension meter connected to the proximal end of the resilient element, wherein the resilient element has a first connecting ring mounted on the proximal end and a second connecting ring mounted to the distal end;

the tension meter further has a lower ring mounted on the bottom of the tension meter; and the resilient tether further has a top ring mounted on the proximal end of the resilient tether;

wherein the first connecting ring is connected to the lower ring of the tension meter; and the second connecting ring is connected to the top ring of the resilient tether.

9. The swim training and buoyancy assist device as claimed in claim 8, wherein the resilient tether has a non-resilient tether inside of the resilient tether.

10. The swim training and buoyancy assist device as claimed in claim 9 further comprising a belt having a side and a ring mounted around the belt; and the resilient tether further has a bottom ring mounted on the distal end of the resilient tether, wherein the bottom ring of the resilient tether is connected to the ring of the belt.

11. The swim training and buoyancy assist device as claimed in claim 10, wherein the resilient element is a spring.

12. The swim training and buoyancy assist device as claimed in claim 8, wherein the resilient element is a spring.

13. A swim training and buoyancy assist device for an anchoring device being mounted at a certain location beside a swimming pool, the swim training and buoyancy assist device comprising:

a resilient element having a proximal end, and a distal end;

a resilient tether connected to the resilient element and having a proximal end connected to the distal end of the resilient end, a distal end;

a non-resilient tether inside of the resilient tether; and a tension meter having a top and a bottom, with the bottom connected to the proximal end of the resilient element, wherein the resilient element has a first connecting ring mounted on the proximal end and a second connecting ring mounted to the distal end;

the tension meter further has a lower ring mounted on the bottom of the tension meter; and the resilient tether further has a top ring mounted on the proximal end of the resilient tether;

wherein the first connecting ring is connected to the lower ring of the tension meter; and the second connecting ring is connected to the top ring of the resilient tether.

14. The swim training and buoyancy assist device as claimed in claim 13 further comprising a belt having a side and a ring mounted around the belt; and the resilient tether further has a bottom ring mounted on the distal end of the resilient tether, wherein the bottom ring of the resilient tether is connected to the ring of the belt.

15. The swim training and buoyancy assist device as claimed in claim 14, wherein the resilient element is a spring.

16. The swim training and buoyancy assist device as claimed in claim 13, wherein the resilient element is a spring.

* * * * *